United States Patent [19]

Gill

[11] 4,364,561

[45] Dec. 21, 1982

[54] PARTY GAME

[76] Inventor: Robert E. Gill, 401 Liberty Blvd., Phillipsburg, N.J. 08865

[21] Appl. No.: 337,022

[22] Filed: Jan. 4, 1982

[51] Int. Cl.[3] ..... A63F 9/00

[52] U.S. Cl. ..... 273/1 G; 273/281

[58] Field of Search ..... 273/1 G, 1 GA, 1 GB, 273/1 GC, 1 GD, 281

[56] References Cited

U.S. PATENT DOCUMENTS 3,458,188 7/1969 Infante ..... 273/1 G X 3,533,622 10/1970 Foley et al. ..... 273/1 G

*Primary Examiner*—Paul E. Shapiro

*Attorney, Agent, or Firm*—Ruth Moyerman

[57] ABSTRACT

A party game for one or more couples. A male part is attached to the flat top of a first belt buckle, and a female part is attached to the second belt buckle. The male part includes a tongue. The female part includes a tunnel with U-shaped side slots that movably retain a double headed marker pin. When the male tongue part is inserted into the female tunnel and moves the marker pin from one slot end to the other, the game task is completed.

5 Claims, 5 Drawing Figures

FIG. 1
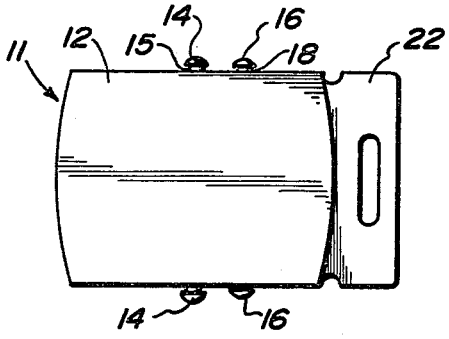
FIG. 3
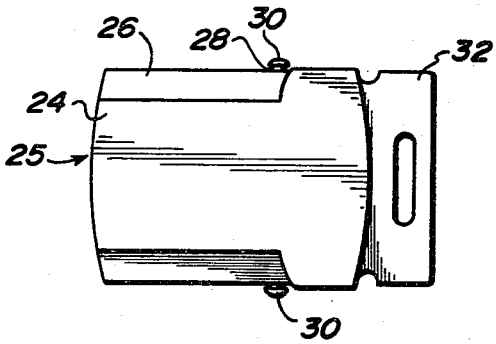
FIG. 2
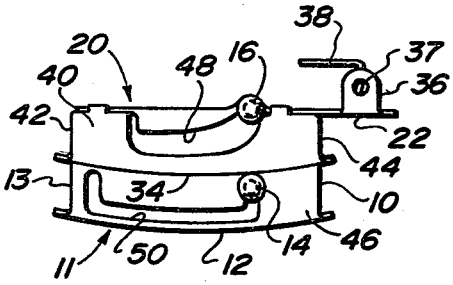
FIG. 4
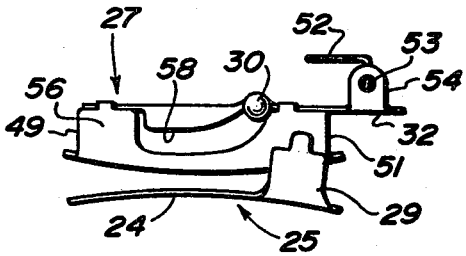
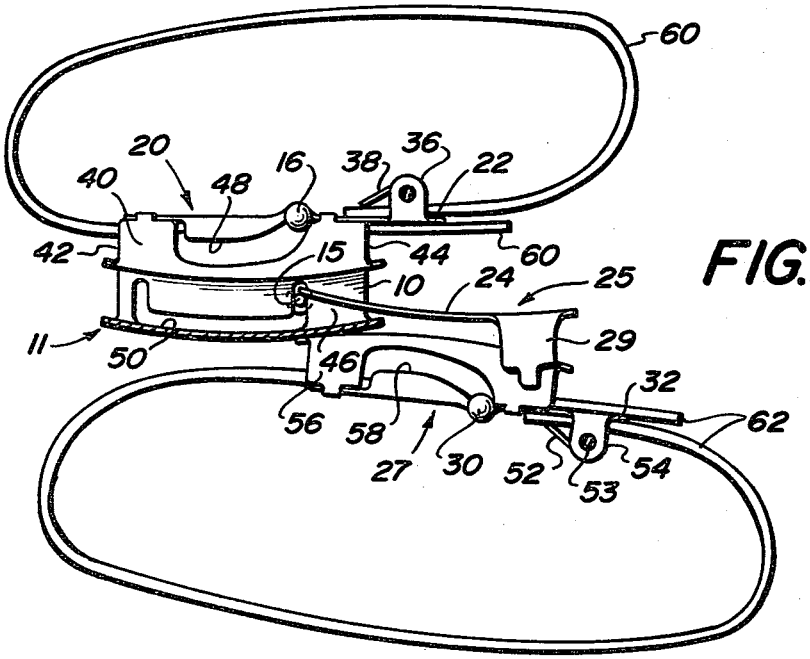
FIG. 5

PARTY GAME

BACKGROUND OF THE INVENTION

1. Field of the Invention

This invention relates to a party game, and more particularly to a game for two people employing the use of belt buckles.

2. Description of the Prior Art

There is a growing market for party games, more especially for games which help people meet informally. The increased popularity of such games calls for new and different games. Many such games presently available are limited by the skill needed to play them, the complexity of their rules, the number of players, and the room needed in which to play them.

There is, therefore, in this growing market a need for a game for one or more couples which is easy to play, uses little space, and acts as an ice breaker.

SUMMARY OF THE INVENTION

The disclosed invention is a new addition in a new addition to the repertoire of party games presently available. This game has two parts each mounted on an individual belt buckle. The female part is attached to the top of one buckle. This part is a tunnel with side slots between which a marker pin rests. The male part is attached to another belt and includes a tongue designed to fit into the tunnel of the female part.

The game is played when two players fasten the belt buckles to lengths of belting. The players put the belts on their waists so that, when they face each other, the male tongue part faces the female tunnel opening. The game task is completed when the pin the female part is moved from one slot end to the other slot end by inserting the tongue of the male part into the tunnel of the female part. A time limit for completion of the task may be imposed to increase game excitement.

It is, therefore, an object of this invention to provide a game which will act as an ice breaker at a party.

It is a further object of this invention to provide a game which is simple to play.

It is yet another object of this invention to provide game apparatus which is adaptable to the varying sizes of the players.

It is still another object of this invention to provide a game which may be placed by one couple with one set of game parts or by more couples at the same time playing with multiple game sets.

These and other objects will be more readily ascertainable to one skilled in the art from a consideration of the following figures, description and exemplary embodiments.

BRIEF DESCRIPTION OF THE DRAWING(S)

FIG. 1 is a top view of the preferred embodiment of the female part of this invention.

FIG. 2 is a side view of the preferred embodiment of the female part of this invention.

FIG. 3 is a top view of the preferred embodiment of the male part of this invention.

FIG. 4 is a side view of the preferred embodiment of the male part of this invention.

FIG. 5 is a side view with a partial cross section showing both parts in combined operation.

DETAILED DESCRIPTION OF THE PREFERRED EMBODIMENT(S)

Referring now to the drawings, and more particularly to FIGS. 1 and 2, the female game part 11 is shown attached to flat topped belt buckle 20. FIG. 1 is a top elevation showing top 12 of female game part 11 and game marker pin 15 having heads 14. Also shown are belt securing pin 18 with heads 16 and belt buckle clamp support 22.

Both female game part 11 and belt buckle 20 are shown in greater detail in the side view of FIG. 2. Belt buckle 20 is shown having side 40, belt entrance 42 and belt exit 44. Belt securing pin head 16 is shown movably retained in side slot 48. Also shown is buckle clamp 38 pivotally retained in clamp support leg aperture 37 of clamp support leg 36 of U-shaped clamp support 22. Additionally in FIG. 2, female game part 11 is shown having top 12 and side 46 attached to buckle top 34. These form tunnel receiving end 10 and tunnel non-receiving end 13. Marker pin head 14 is shown movably retained in U-shaped side slot 50.

Referring now to FIGS. 3 and 4, male game part 25 and belt buckle 27 are shown. FIG. 3 is a top elevation showing tongue 24 of male game part 25 mounted on flat topped belt buckle top 26. Also shown are belt buckle clamp support 32 and belt securing pin 28 having heads 30.

Both male game part 25 and belt buckle 27 are shown in greater detail in the side view of FIG. 4. Belt buckle 27 is shown having side 56, belt entrance 49 and belt exit 51. Belt securing pin head 30 is shown movably retained in side slot 58. Also shown is buckle clamp 52 pivotally retained in clamp support leg aperture 53 of clamp support leg 54 of U-shapedclamp support 32. In addition, FIG. 4 also shows male game part 25 having tongue 24. Tongue 24 is shown in cantilevered position having support 29 attached to belt buckle side 56.

Referring now to FIG. 5, female game part 11 attached to belt buckle 20 is shown in operation with male game part 25 attached to belt buckle 27. In preparation for the game, players attach belts 60 and 62 into their respective buckles. The female player inserts one end of belt 60 between clamp 38 and clamp support 22. Clamp 38 is pressed firmly against belt 60, securing it to buckle 20. The opposite end of belt 60 is inserted into belt entrance 42 and out exit 44. Belt securing pin 16 is moved in buckle slot 48 until belt 60 is held fast. The male player inserts belt 62 into buckle 27 in the same manner as described for the female.

To complete the game task, male tongue 24 must be inserted into female tunnel receiving end 10 urging forward marker pin 15 (shown in cross section) from nearer end of U-shaped side slot 50 to further end of slot 50.

There are many variations which may be practiced within the scope of this invention. Although a standard military belt buckle is shown as the preferred embodiment, any flat topped belt buckle will serve the purpose. However, because of the type of buckle used in the preferred embodiment, persons of all sizes may use this device.

Although cantilevered tongue 24 of male part 25 is shown in FIG. 4 having support 29 as separate from the buckle 27, cantilevered tongue 24 may be continuous with buckle 27.

Also, any suitable belting may be used in conjunction with this game device.

Having now described and illustrated my invention, it is not intended that such description limit this invention, but rather that this invention be limited only by a reasonable interpretation of the apended claims.

What is claimed is:

1. A party game in combination with two flat topped belt buckles comprising:

(a) a female part attached to one of said buckle tops, said female part comprising:

(i) a tongue receiving tunnel having opposed U-shaped side slots; and (ii) a double headed marker pin movably retained in and spanning said slots;

(b) a male part comprising a cantilevered tongue attached to said second buckle top in overlying spaced-apart registration, said male tongue part and said female tunnel being positioned in their respective buckle tops so that said tongue edge faces said tunnel opening; whereby, when said male tongue part is inserted into said female tunnel, said tongue can urge said marker pin forward from one slot end to the other.

2. A party game according to claim 1 wherein said flat topped belt buckles are standard military buckles.

3. A party game according to claim 1 wherein said buckles are attached to an adjustable length of belting.

4. A party game according to claim 1 wherein said cantilevered tongue may be continuous at its supported end with said belt buckle top.

5. A party game according to claim 1 wherein said female tunnel part may be closed at its non receiving end.

* * * * *